US005228482A

United States Patent [19]

Fleischer

[11] Patent Number: 5,228,482

[45] Date of Patent: Jul. 20, 1993

[54] PAPERMAKING FABRIC WITH DIAGONALLY ARRANGED POCKETS

[75] Inventor: Thomas B. Fleischer, Pelzer, S.C.

[73] Assignee: Wangner Systems Corporation, Greenville, S.C.

[21] Appl. No.: 908,472

[22] Filed: Jul. 6, 1992

[51] Int. Cl.[5] ..... D03D 13/00

[52] U.S. Cl. ..... 139/383 A

[58] Field of Search ..... 139/383 A

[56] References Cited

U.S. PATENT DOCUMENTS

| | | | |
|---|---|---|---|
| Re. 33,195 | 4/1990 | McDonald et al. | 139/383 A |
| 2,713,361 | 7/1955 | Dangel et al. | 139/426 R |
| 4,157,276 | 6/1979 | Wandel et al. | 139/383 A |
| 4,161,195 | 7/1979 | Khan | 139/383 A |
| 4,239,065 | 12/1980 | Trokhan | 139/383 A |
| 4,376,455 | 3/1983 | Hahn | 139/383 A |

FOREIGN PATENT DOCUMENTS

| | | | |
|---|---|---|---|
| 0106775 | 4/1984 | European Pat. Off. | 139/383 A |

*Primary Examiner*—Andrew M. Falik

*Attorney, Agent, or Firm*—Cort Flint; Henry S. Jaudon

[57] ABSTRACT

A woven fabric for use on paper machines having a support surface and a running surface. The fabric comprises a first set of filaments disposed in generally parallel relationship and in a machine direction, a second set of filaments disposed generally in parallel relationship in a cross machine direction and transversely of said first set of filaments. These sets of filaments are interwoven with each other so as to be serpentinely configurated to provide a first grouping of machine direction filaments having coplanar support surface crossovers and a second grouping of sub-support surface crossovers. The cross machine direction filaments are arranged to have coplanar support surface crossovers which are also recessed below said machine direction first crossover grouping by an equal depth which is between 5% and 50% of the diameter of the machine direction filaments. The first grouping of the machine direction and the cross machine direction crossovers are spaced so as to define diagonally arranged cavities across the support surface of the fabric. The cavities are separated from each other across the support surface by the first grouping of machine direction crossovers and are interconnected in said machine direction along the length of the fabric at the cross machine direction crossovers.

19 Claims, 2 Drawing Sheets

PAPERMAKING FABRIC WITH DIAGONALLY ARRANGED POCKETS

This invention is directed to a paper machine fabric formed of synthetic filaments which is suitable for air drying, wet end application and dryer section application. The fabric is constructed to have improved wear resistance, stability and increased pocket depth.

BACKGROUND OF THE INVENTION

There have been numerous attempts in the prior art to provide a papermaking fabric capable of producing softer more even paper products while at the same time providing extended fabric life. U.S. Pat. Nos. 4,157,276 and 4,239,065 are directed to paper forming fabrics which present a paper support surface in which the high points of both the warp and weft filaments lie in a single horizontal plane, i.e. a monoplane support surface. The patent to Trokhan goes further by providing sub-surface crossovers in the warp direction which produce cavities on the paper support surface. These cavities are surrounded by monoplanar high points of selected warp filaments and the weft filaments.

U.S. Pat. No. 4,161,195 to Kahn is directed to a synthetic paper forming fabric having long weft knuckles on the running surface for better wear and variable height support surface nucleus. The patent is intended to remove transverse markings and to have extended fabric stability and wear resistance.

It has been found that there is difficulty in maintaining uniform paper fiber orientation along and across the paper product using paper product support surfaces as described above.

Accordingly, it is an object of the present invention to provide a paper forming fabric having a paper product support surface with deep interconnected pockets extending transversely along and across the support surface width.

It is further object to produce a paper forming fabric having a paper product support surface which produces good uniform fiber orientation.

It is still a further object of the invention to provide a paper machine fabric capable of producing paper having an increased softness.

It is still a further object of the invention to produce a paper forming fabric having improved wear resistance on the running side.

It is still a further object of the invention to produce a paper forming fabric of improved stability.

SUMMARY OF THE INVENTION

In accordance with the invention there is provided a woven fabric for use on paper machines having a support surface and a running surface. The fabric comprises a first set of filaments disposed in generally parallel relationship in a machine direction, a second set of filaments disposed generally in parallel relationship in a cross machine direction and transversely of the first set of filaments. These sets of filaments are interwoven with each other so as to be serpentinely configurated to provide a first grouping of machine direction filaments having coplanar support surface crossovers, a second grouping of sub-support surface machine direction crossovers and cross machine direction filaments having coplanar support surface crossovers which are recessed below the machine direction first crossover grouping by an equal depth which is between five percent and forty-five percent of the diameter of the machine direction filaments. The first grouping of the machine direction and the cross machine direction crossovers are spaced so as to define diagonally arranged pockets across the support surface of the fabric. The pockets are separated from each other across the support surface by the first grouping of machine direction crossovers and are interconnected in the machine direction along the length of the fabric at the cross machine direction crossovers.

The filaments are synthetic monofilaments of polyester, polyamid and polyaryletherketones (PEEK). The satin weave is a five shed satin or Atlas pattern. The pockets span generally two machine direction filaments and one cross machine direction filament. The second grouping of subsurface crossovers which form the lower extremities of the pockets are submerged below the support surface at a second depth which is up to twice that of the submerged depth of the crossovers of the cross machine filaments.

The running surface is formed to have coplanar crossovers of the cross machine direction filaments extending below crossovers of the machine direction filaments. Thus, the cross machine direction filaments form that portion of the running surface which contacts support rollers of the paper forming machine. These running surface crossovers of the cross machine direction filaments extend below the running surface crossovers of the machine direction filaments by at least ten percent of the diameter of the machine direction filaments.

The fabric is woven to have a count of between 10 by 10 to 120 by 120 filaments per inch. The filaments have a diameter of between 0.14 mm and 1.0 mm. A fabric for use with a paper forming machine comprising a set of MD synthetic filaments having a first diameter and which are in a five shed Atlas weave pattern with the MD filaments passing over four and under one of the CD filaments to form a MD filament dominant first surface and a CM filament dominant second surface. The upper surface of the MD filaments are arranged on the first surface to extend along a common plan which is above a plane formed by the uppermost surfaces of the CM filaments by an amount equal to at least 5 percent of the diameter of the MD filaments. Also, a lower surface of the CM filaments is arranged on the second surface to extend along a common plane which is below a plane formed by the lower most surfaces of the MD filaments by an amount equal to at least 5 percent of the diameter of the MD filaments. Accordingly, a fabric having improved wear resistance and increased pocket depth is provided.

DESCRIPTION OF A PREFERRED EMBODIMENT

The terms warp and weft yarns are directed toward yarns as employed on the loom. Warp yarns are mounted on the loom and constitute those yarns which extend along the length of the fabric. Weft yarns are passed transversely through the warp during wearing and constitute those yarns which extend width-wise the fabric. In use on a paper forming machine, the fabric may be adapted to the machine so that either the warp or weft extend in the machine direction (MD) or the cross machine direction (CM).

It has been found that in order to obtain optimum results in papermaking two things are necessary. A papermaking fabric having good wear resistance and good stability to achieve optimum economy is necessary. Also, the paper forming fabric must have uniform surface configurations and selectively spaced and interconnected sub-surface pockets to achieve increased paper softness in combination with uniformity of construction. The instant invention achieves both of these objectives.

Figure 1:
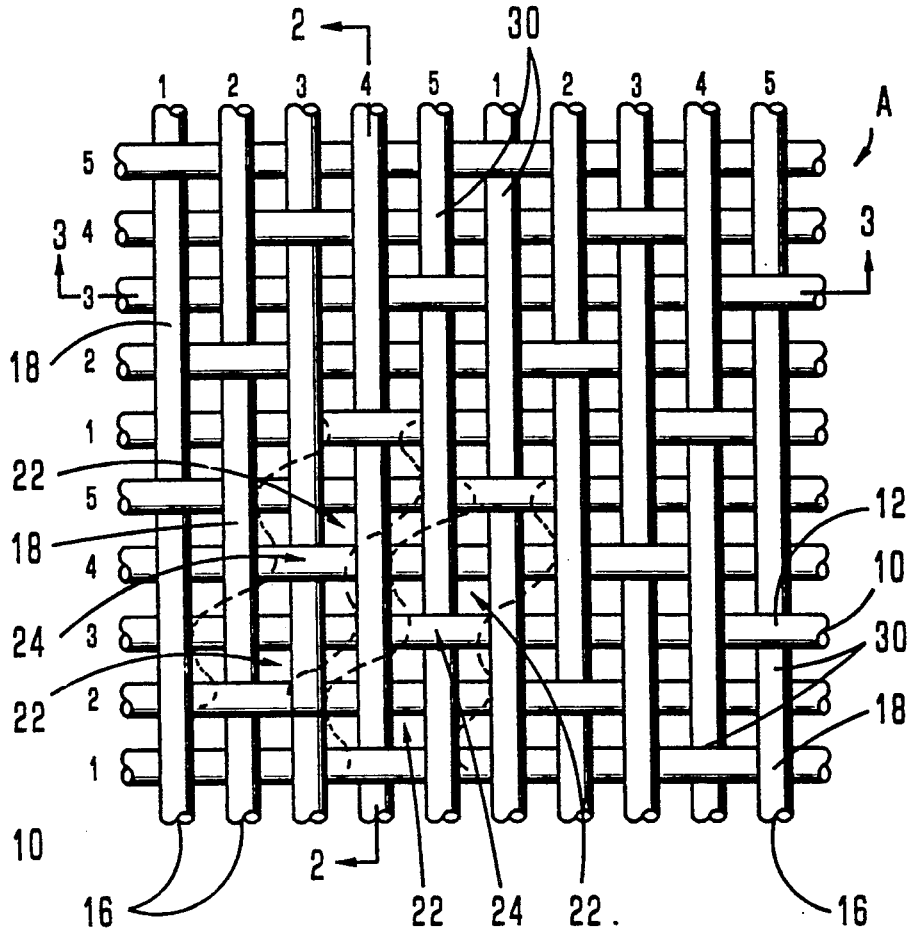
FIG. 1 is a top view of the fabric of the invention showing pockets arranged diagonally across the support surface of the fabric.

Referring now to the drawings, FIG. 1 shows a section of the paper stock support surface B of paper forming fabric A. The fabric is woven in a 4/1 satin or Atlas weave pattern which is a five shed fabric. That means that the warp filaments 16 are woven in a pattern with weft filaments 10 so that each warp filament passes over four weft filaments and then beneath the next weft filament. FIG. 1 shows the first warp filament 16 of the pattern repeat designated 1 weaving in this manner over the first four weft filaments 1, 2, 3 and 4 of the pattern repeat while weaving under the last weft filament 5 of the pattern repeat. The second warp 16 of the pattern repeat designated 2, weaves first over, first weft filament 1, under second weft filament 2 and then over the remainder of the weft filaments 3, 4 and 5. The third warp filament 3 of the pattern repeat, weaves over weft filaments 1, 2 and 3, under weft filament 4 and finally over weft filament 5. The fourth warp filament 4 of the pattern repeat weaves under weft filament 1 and over weft filaments 2, 3, 4, and 5. The last warp filament 5 of the pattern repeat weaves over weft filaments 2 under weft filament 3 and finally over weft filaments 4 and 5. This weave sequence is repeated width-wise and length-wise throughout the fabric.

Figure 2:
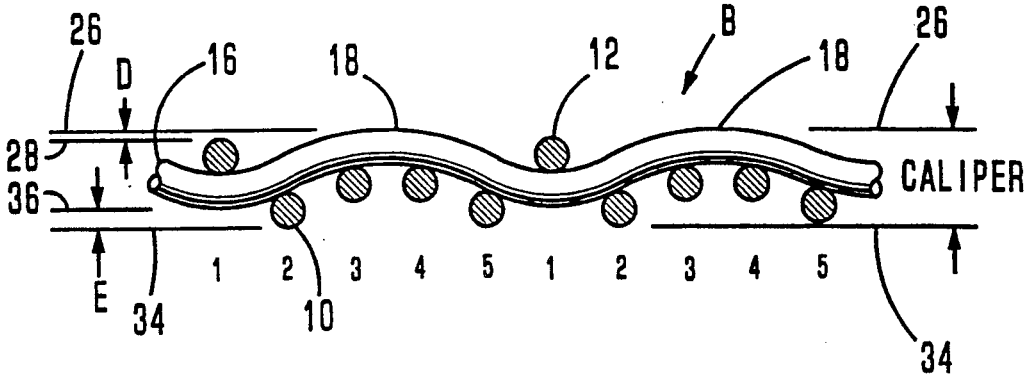
FIG. 2 is a sectioned side view of the fabric of the invention taken along line 2—2 of FIG. 1.
Figure 3:
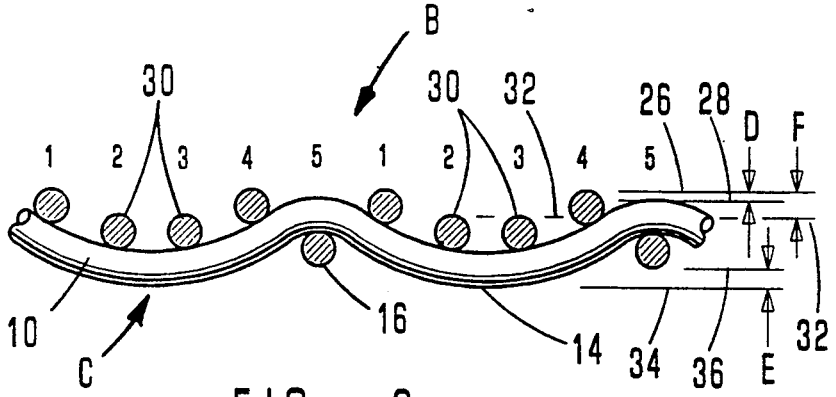
FIG. 3 is a sectional end view of the fabric of the invention taken along line 3—3 of FIG. 1.

Referring now to FIGS. 1 through 3, it can be seen on the support side B of fabric A that the upper most surfaces 18, formed by the warp filaments 16, pass over weft filaments 10 and are disposed in a single horizontal plane designated 26. These crossover points may be referred to as warp knuckles. The upper most surfaces 12 of weft filaments 10 are shown as also being arranged along a single horizontal plane designated 28 which is beneath the level of plane 26.

Figure 4:
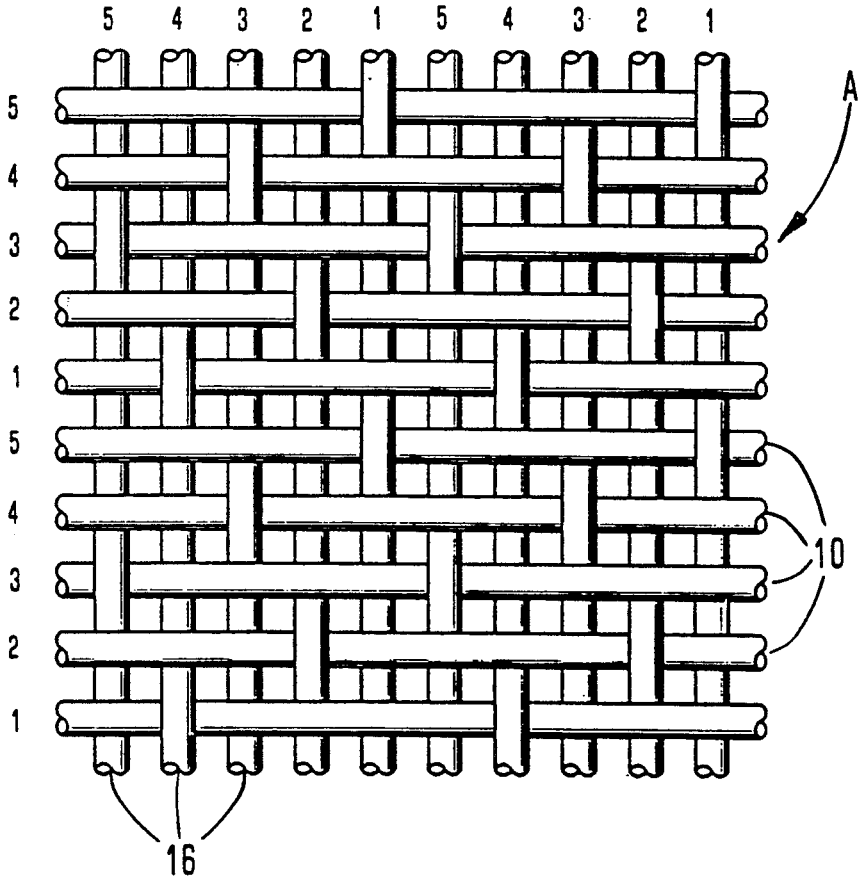
FIG. 4 is a view from below the fabric of the invention as shown in FIG. 1.

FIGS. 2 through 4 show the running side C of fabric A as a weft filament dominated surface. The weave pattern shown in FIG. 4 is identical to that shown in FIG. 1 except that it shows the fabric from its under side and as such is reversed. Where in FIG. 1, the warp filaments 16 are shown as passing over weft filaments 10, they now are shown as passing below these filaments. FIGS. 2 and 3 shown the lower most surfaces 14 of the weft filaments 10 being along horizontal line 34 while the lower most surfaces of warp filaments 16 at the cross under points lie along horizontal plane 36 which is submerged inwardly of plane 34 by a distance indicated E. The distance E is equal to between five percent and forty-five percent of the diameter of warp filaments 16.

Viewing now FIGS. 2 and 3, on support surface B, the upper most portions of warp filaments 16 extend along horizontal plane 26 and the upper most portions of weft filaments 10 extend along horizontal plane 28. The distance between these planes is identified as D. On the running side of C of fabric A, the lower most points of weft filaments 10 extend along horizontal plane 34 while the lower most points of warp filaments 16 are disposed along horizontal plane 36. The distance between planes 34 and 36 is identified as E.

The thickness of the fabric or the caliper is indicated in FIG. 2. The caliper or fabric thickness is equal to the diameter of filaments 10 plus the diameter of filaments 18 plus D plus E. D plus E is equal to fifty percent of the diameter of filaments 16 with D being equal to between five percent and forty-five percent of that diameter and E being equal to between forty-five percent and five percent of that diameter.

FIGS. 1 and 3 show the crossover points designated 30 for warp filaments whose upper portions lie along horizontal plane 32 which is below both plane 26 and plane 28. The distance between plane 26 and 32 is designated F and is equal to between ten percent and forty-five percent of the diameter of warp filaments 16. The crossovers 30 form the upper support surface of sub-surface pockets 22 on support surface B. As clearly seen in FIG. 1, pockets 22 extend progressively along the length of the fabric and also progressively diagonally transversely of the fabric across its entire width. Pockets 22 are bounded across the width of fabric A by crossovers 18 of Warp filaments 16 and along the length of the fabric by crossovers 12 of the weft filaments 10. Pockets 22 span over generally two warp filaments 16 and one weft filament 10. Because crossovers 12 are arranged below plane 26 and along plane 28, the pockets 22 are also interconnected with adjacent pockets at areas 24 which are arranged diagonally along the length and width of the fabric. This arrangement allows for pockets 22 to be formed at a greater depth and also allows for continuous continuity between the pockets and therefore greater control and uniformity of the paper forming material while on the support surface of the fabric.

The weave disclosed provides that fabric A have a support surface B dominated by warp filaments 16 and a running surface C dominated by weft filaments 10. This arrangement provides greater resistance to wear because the weft filaments contact the support rollers of the paper forming machine and initially take the wear of this contact. Also, as the greater stress is in the MD, the stability of the fabric is enhanced by not exposing the warp filaments to direct contact with the support rollers of the paper machine which tends to weaken them. It is however understood that the invention does not preclude utilizing fabric side B as the running side and side C as the support side.

After weaving, fabric A is subjected to a heat treatment under tension. I is during this treatment that the serpentine configurations of warp and weft filaments 10 and 16 are brought to and set in the positions shown in FIGS. 1 through 4 as described above. Heat treating of paper forming fabrics is well known and the treatment per se forms no part of the instant invention.

Filaments 10 and 16 are preferably polyester monofilaments. However, other synthetic materials such as polyamids, polyaryletherketones (PEEK) may also be employed singularly or in combination with polyester. The filaments may also be formed as multi-filaments.

Preferably the filaments 10 and 16 are of a diameter between 0.14 mm and 1.0 mm. It is also an alternative to provide that the MD filaments have a rectangular or oblong cross section as illustrated in U.S. Pat. No. 4,351,874. Fabric A may be woven with a fabric count of between 10×10 to 120×120 filaments per inch. A preferred fabric is woven with a count of 40×40 filaments per inch and a yarn diameter of 0.4 mm. Clearly fabrics woven with different filament diameters between the warp and weft may be employed.

While only a particular embodiment has been illustrated and described it would be obvious for those skilled in the art that minor changes and modifications can be made without departing from the spirit and scope of the invention.

What is claimed is:

1. A woven fabric for use on paper machines having a support surface and a running surface, said fabric comprising a first set of synthetic filaments disposed in generally parallel relationship and in a machine direction; a second set of synthetic filaments disposed generally in parallel relationship in a cross machine direction and transversely of said first set of filaments; said first and second sets of filaments being interwoven with each other so as to be serpentinely configured to provide a first grouping of machine direction filaments having coplanar support surface crossovers which cross over filaments of said cross machine direction filaments and lie along a first substantially horizontal plane, and a second grouping of machine direction filaments having sub-support surface crossovers which cross over filaments of the cross machine direction filaments and lie along a second substantially horizontal plane spaced below said first substantially horizontal plane, and said set of cross machine direction filaments having coplanar support surface crossovers which cross over machine direction filaments and are recessed below said first plane formed by said first grouping of machine direction crossovers, said set of cross machine crossovers are disposed above said second plane of said second grouping of machine direction crossovers, said first grouping of machine direction crossovers and said cross machine direction crossovers are arranged in spaced relationship so as to define diagonally arranged pockets across said support surface, said pockets being separated from each other across said support surface by said first grouping of machine direction crossovers and interconnected in said machine direction along the length of said fabric at said cross machine direction crossovers.

2. The fabric of claim 1 wherein said filaments are synthetic monofilaments.

3. The fabric of claim 2 wherein said monofilament are comprised of at least one of polyester, polyamid and polyaryletherketones.

4. The fabric of claim 1 wherein said weave is a five shed satin or Atlas pattern.

5. The fabric of claim 1 wherein said pockets span generally two machine direction filaments and one cross machine direction filament.

6. The fabric of claim 1 wherein said equal depth of said cross machine direction crossovers is equal to at least 5% and no more than 45% of the diameter of the machine direction filaments.

7. The fabric of claim 1 wherein said second grouping of subsurface crossovers are submerged below said support surface at a second depth which is substantially at least twice that of said submerged depth of said crossovers of said cross machine filaments.

8. The fabric of claim 1 wherein on said running surface, coplanar crossovers of said cross machine direction filaments extend below crossovers of said machine direction filaments so that said cross machine direction filaments form that portion of the running surface which contacts support rollers of said paper forming machine.

9. The fabric of claim 8 wherein running surface crossovers of said cross machine direction filaments extend below running surface crossovers of said machine direction filaments by between 5% and 45% of the diameter of said machine direction filaments.

10. The fabric of claim 1 wherein said fabric has a count of between 10 by 10 to 120 by 120 filaments per inch.

11. The fabric of claim 1 wherein said filaments have a diameter of between 0.14 mm and 1.0 mm.

12. A fabric for use with a paper forming machine comprising a set of MD synthetic filaments having a first diameter and which are interwoven with a set of CM synthetic filaments having a second diameter, the combination of:

a five shed Atlas weave pattern with said MD filaments passing over four and under one of said CM filaments to form a MD filament dominant first surface and a CM filament dominant second surface;

first uppermost surface areas of said MD filaments are arranged on said first surface to extend along a common substantially horizontal first plane which is above a second common substantially horizontal second plane formed by uppermost surface areas of the CM filaments by an amount equal to at least 5 percent of the diameter of said MD filaments;

second upper most surface areas of said MD filaments are arranged over said first surface along a common substantially horizontal third plane which is below said second plane formed by said uppermost surface areas of the CM filaments by a first distance and are also below said first plane formed by said uppermost surface areas of said MD filaments by a second greater distance, said first uppermost surfaces of said MD filaments and said upper surfaces of said CM filaments forming pockets over said first surface, and;

lower surface areas of the CM filaments are arranged on the CM filament dominant second surface to extend along a common substantially horizontal fourth plane which is below a common substantially horizontal fifth plane formed by lower most surfaces areas of said MD filaments by an amount equal to at least 5 percent of the diameter of said MD filaments;

whereby a fabric having improved wear resistance and increased pocket depth is provided.

13. The fabric of claim 12 wherein said first surface comprises a paper product support surface and said second surface comprises a running surface.

14. The fabric of claim 12 wherein said second surface comprises a paper product support surface and said first surface comprises a running surface.

15. The fabric of claim 12 wherein said MD filaments are rectangular in cross section.

16. The fabric of claim 12 wherein the distance between said planes of said MD and CM filaments forming said upper surface and the distance between the plains of said MD and CM filaments forming said second surface combined are equal to 50% of the diameter of the MD filaments.

17. The fabric of claim 12 wherein the diameters of the MD filaments and CM filaments is equal.

18. The fabric of claim 12 wherein the diameters of the MD filaments and CM filament differ.

19. The fabric of claim 12 wherein sub-surface pockets are formed on said first surface, said pockets are arranged in transversely spaced rows which extend diagionally along said first surface, said pockets being separated by said uppermost surfaces of said MD filaments and interconnected at said uppermost surface of said CM filaments.

* * * * *